United States Patent [19]

Asmussen

[11] Patent Number: 4,792,772

[45] Date of Patent: Dec. 20, 1988

[54] MICROWAVE APPARATUS

[75] Inventor: Jes Asmussen, Okemos, Mich.

[73] Assignee: Michigan State University, East Lansing, Mich.

[21] Appl. No.: 88,377

[22] Filed: Aug. 24, 1987

[51] Int. Cl.[4] ..... H01P 7/06

[52] U.S. Cl. ..... 333/230; 333/231; 333/233; 333/248

[58] Field of Search ..... 333/227, 230, 231, 233, 333/234, 208–212, 248; 315/39; 331/96; 324/81

[56] References Cited

U.S. PATENT DOCUMENTS

| | | | |
|---|---|---|---|
| 2,311,520 | 2/1943 | Clifford | 315/39 |
| 2,439,388 | 4/1948 | Hansen | 333/233 |
| 2,605,459 | 7/1952 | Cook | 333/228 |
| 2,853,678 | 9/1958 | Tomiyasu | 324/81 |
| 4,507,588 | 3/1985 | Asmussen et al. | 315/39 |
| 4,585,668 | 4/1986 | Asmussen et al. | 427/38 |
| 4,630,566 | 12/1986 | Asmussen et al. | 315/111.41 |

*Primary Examiner*—Marvin L. Nussbaum
*Attorney, Agent, or Firm*—Ian C. McLeod

[57] ABSTRACT

An apparatus 10 with gears (22a, 22b, 22c, 25) for adjusting the position of a plate (13) in a cavity (12) and a rack (51) and gear (53) for moving a probe (15) into and out of the cavity is described. The apparatus includes knobs (34, 55) for controlling the movement of the plate and probe. Micrometers (37, 52) measure the precise position of the plate and probe in the cavity. The apparatus allows very precise tuning for selection of a mode of radiofrequency wave in the cavity and fine tuning within the mode.

19 Claims, 4 Drawing Sheets

MICROWAVE APPARATUS

Figure 1:
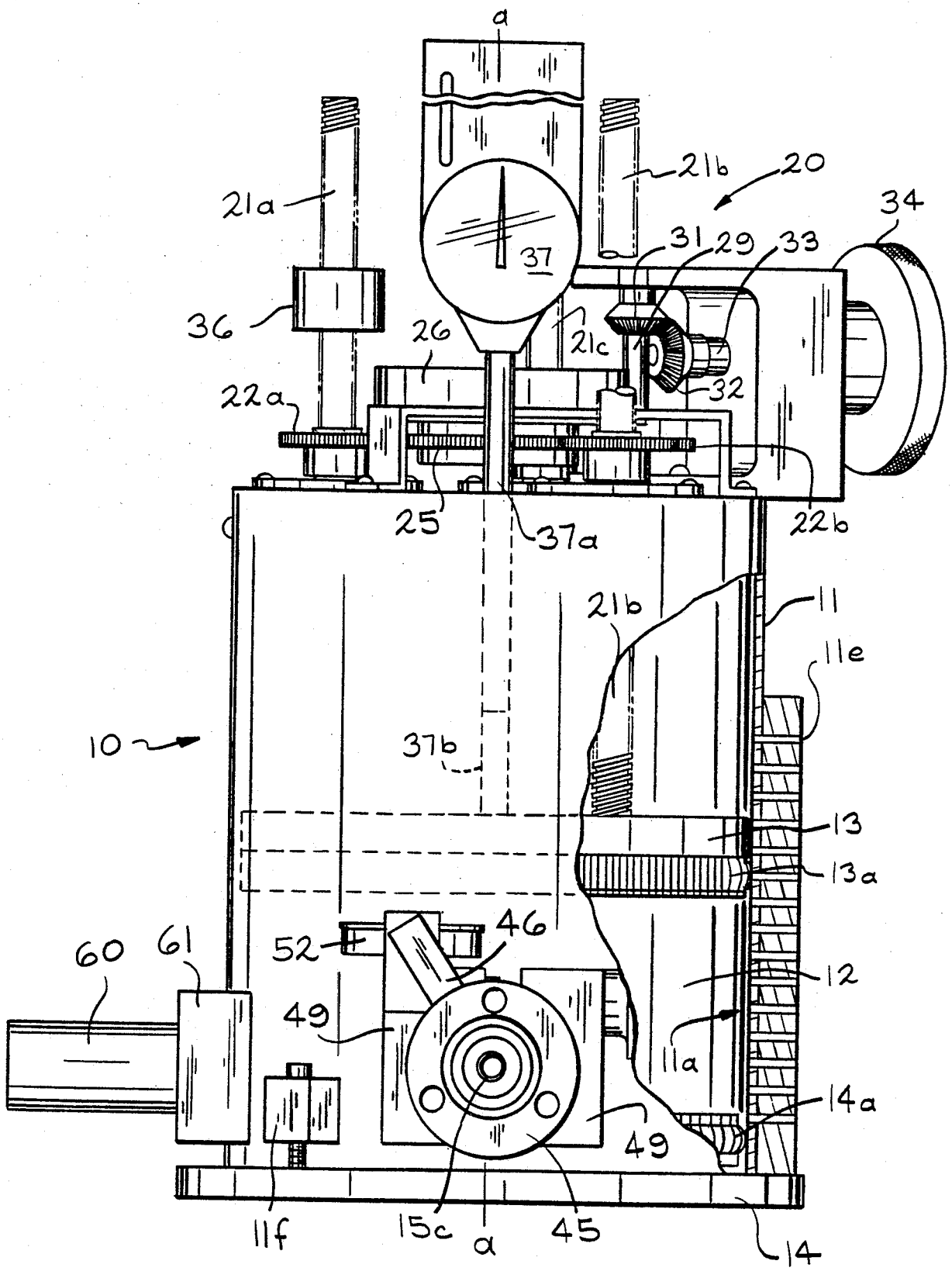

BACKGROUND OF THE INVENTION (1) Summary of the Invention

The present invention relates to an improved radiofrequency wave generating apparatus which allows fine adjustments of a moveable probe and plate in a cavity confining the wave. In particular the present invention relates to an apparatus wherein micrometers are used to make the fine adjustments of the plate and probe in the cavity.

(2) Prior Art

The basic radiofrequency apparatus are described in U.S. Pat. Nos. 4,507,588 to Asmussen and Root and 4,585,668 and 4,630,566 to Asmussen and Reinhard. These patents describe the creation of disc plasmas in a chamber wherein the mode and tuning of the radiofrequency wave in a cavity around the chamber is controlled by a moveable probe and plate. The problem has been the fine tuning of the probe and the plate.

OBJECTS

It is therefore an object of the present invention to provide an improved wave generating apparatus which allow fine tuning of the probe and the plate in the cavity so as to control the mode or tuning of the mode in a cavity. Further it is an object of the present invention to provide an apparatus which is relatively simple and economical to construct and use. These and other objects will become increasingly apparent by reference to the following description and the drawings.

IN THE DRAWINGS

FIG. 1 is a front partial sectional view of the preferred apparatus 10 of the present invention particularly showing a mechanism 20 for moving the plate 13 in the cavity 12 and a micrometer 37 for measuring changes of the position of the plate 13.

Figure 2:
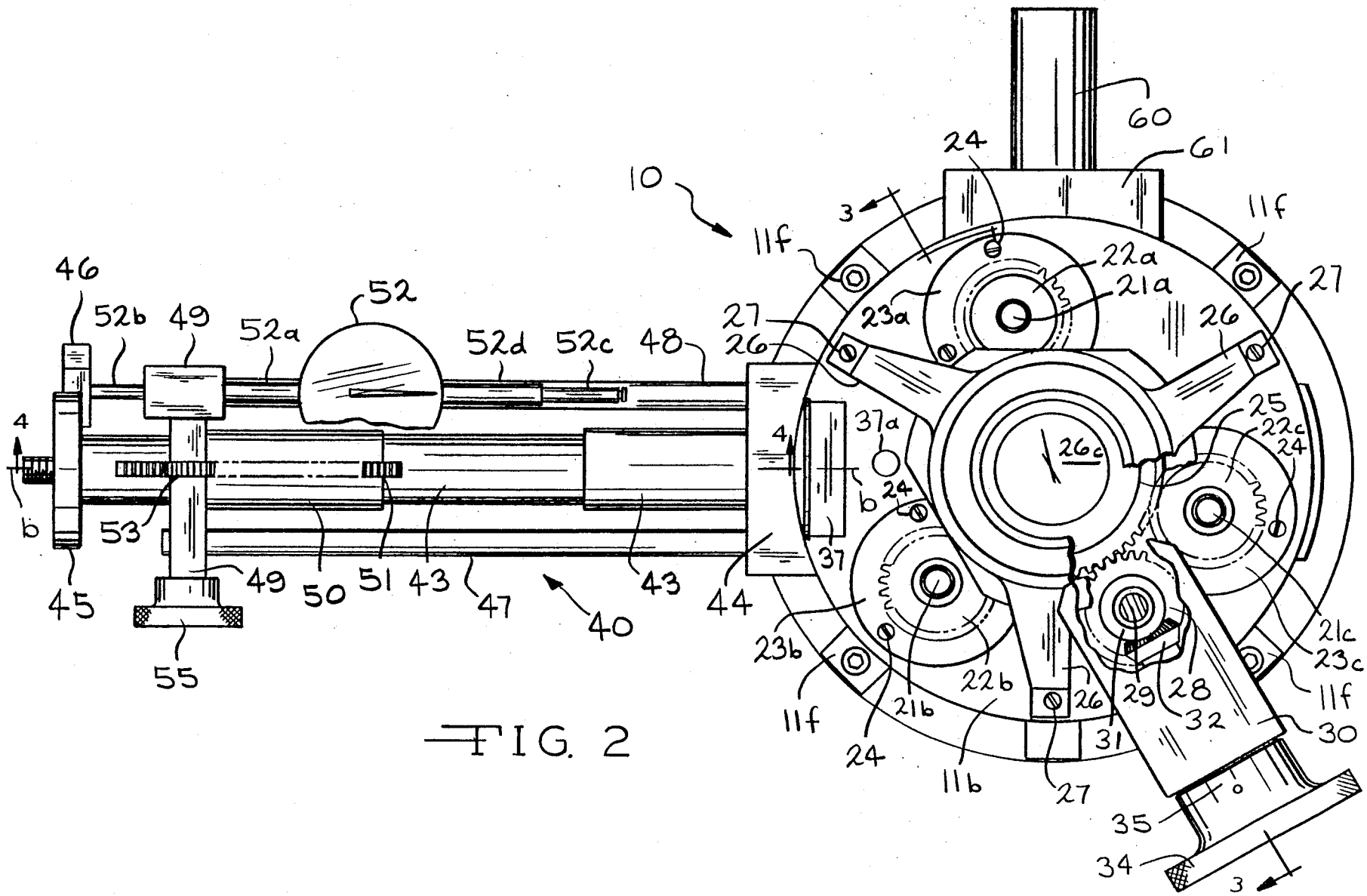

FIG. 2 is a plan view of the apparatus 10 of FIG. 1 showing the mechanism 40 for moving the probe 15 in the cavity 12.

Figure 3:
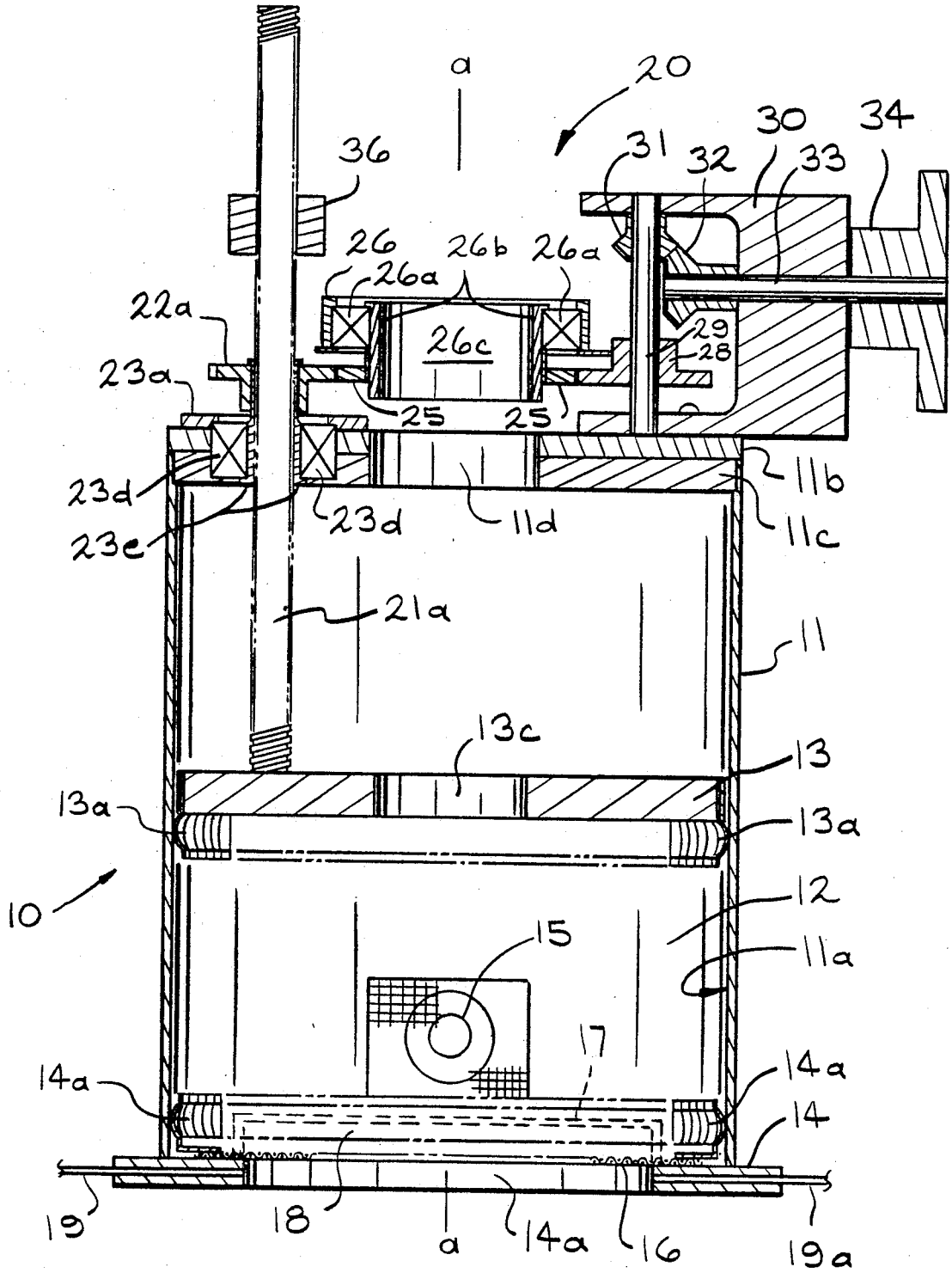

FIG. 3 is a front cross-sectional view of the apparatus of FIG. 1 showing the mechanism 20.

Figure 4:
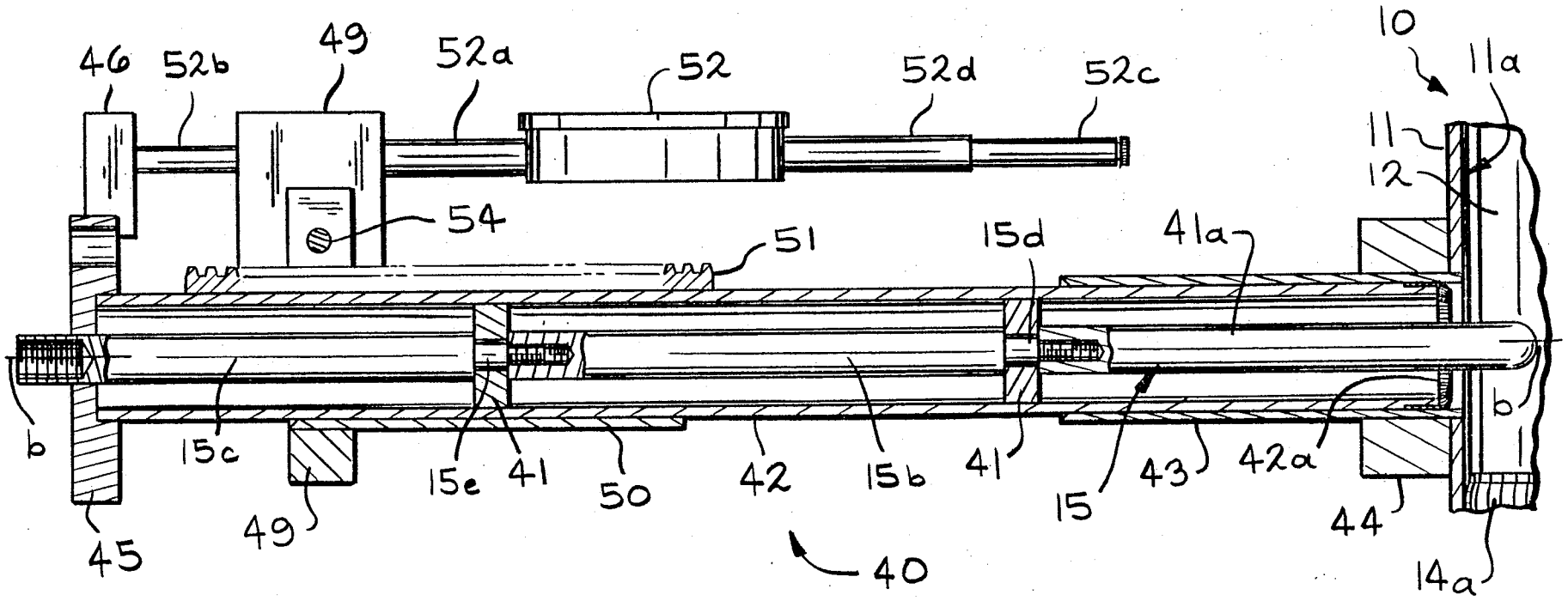

FIG. 4 is a plan cross-sectional view of the mechanism 40 for moving the probe 15, particularly showing a micrometer 52 for measuring the changes of position of the probe 15 in the cavity 12.

GENERAL DESCRIPTION

The present invention relates to an improved radiofrequency wave generating apparatus including a metallic radiofrequency wave cavity which is excited in one or more of its modes of resonance in the cavity around a central axis of the cavity including moveable plate means in the cavity mounted perpendicular to the central axis in the cavity and moveable along the central axis, moveable probe means connected to and extending inside the cavity for coupling the radiofrequency wave to the cavity and control means for moving the probe means and plate means in order to select and control the mode of the radiofrequency wave in the cavity wherein the improvement is in the control means for positioning the probe means and the plate means in the cavity which comprises: support means mounted on the apparatus adjacent an opening in the cavity; sliding means mounting the probe means and mounted on the support means so as to linearly move the probe means into and out of the opening in the cavity along a longitudinal axis of the probe means; first micrometer means mounted between the support means and the sliding means so as to measure the position of the probe means in the cavity; guiding means moveably mounting the plate means in the cavity of the apparatus and providing for precise positioning of the plate means along the central axis; second micrometer means mounted between the apparatus and the plate means so as to measure the position of the plate means in the cavity; and motive means for moving the sliding means and guiding means to control the position of the probe means and plate means in the cavity and providing precise movement of the probe means and plate means in the cavity as determined by the first and second micrometer means.

In particular the present invention relates to an improved radiofrequency wave generating apparatus including a metallic radiofrequency wave cavity which is excited in one or more of its modes of resonance in the cavity around a central axis of the cavity including moveable plate means in the cavity mounted perpendicular to the central axis in the cavity and moveable along the central axis, moveable probe means connected to and extending inside the cavity for coupling the radiofrequency wave to the cavity and control means for moving the probe means and plate means in order to select and control the mode of the radiofrequency wave in the cavity wherein the improvement is in the control means for positioning of the probe means and the plate means in the cavity which comprises: probe means having a longitudinal axis; spaced apart locating members mounted along and around the longitudinal axis of the probe means; a tube mounted on the locating members along the longitudinal axis so that the probe means extends from one end of the tube; a receiver defining an opening into the cavity wherein the tube is slideably mounted in the opening with probe means extending at the one end of the tube into the cavity; rack means mounted on the tube parallel to the longitudinal axis of the probe means; electrical connector means mounted on the tube at an end opposite the one end including a projection away from the longitudinal axis of the probe means; at least one post mounted on the apparatus so as to support the tube for linear movement of the tube and probe means together into and out of the apparatus; a holder mounted on the post with an opening slideably supporting the tube between the posts and positioning the tube in the opening in the receiver; a first dial micrometer mounted on the holder having a moveable stem connected to the dial which engages the projection on the connector means to measure the position of the probe in the cavity as a result of a change of position of the stem; rotatable first gear means supported on the holder which engages the rack means to move the tube and probe means into and out of the cavity; a second dial micrometer mounted on the apparatus with a moveable stem connected to the dial engaging the plate means to measure the position of the plate means along the central axis in the cavity as a result of a change of position of the stem; at least one threaded rod mounted on the plate means parallel to the central axis extending from the cavity of the apparatus; rotatable second gear means mounted on the threaded rod outside of the cavity for adjusting the position of the plate means in the cavity; and motive means for moving the first and second gear means to provide precise movement of the probe means and plate means in the cavity as determined by the first and second dial micrometers.

The apparatus preferably includes magnets surrounding the chamber and mounted on the sliding short in order to confine the plasma in the chamber to the extent desired. This apparatus is described in U.S. application Ser. No. 849,052 filed Apr. 7, 1986, and now U.S. Pat. No. 4,727,293.

The apparatus can be used to practice the method of U.S. application Ser. No. 41,291 filed Apr. 22, 1987. The patterns of heating of materials are determined as a function of time. Further the changing dielectric constants as a function of the heating can be determined.

SPECIFIC DESCRIPTION

FIGS. 1 to 3 show the preferred radiofrequency wave generating apparatus 10 of the present invention. FIG. 4 shows a portion of the apparatus 10. A circularly cross-sectioned, electrically conductive housing 11 defines a cavity 12 around longitudinal axis a—a for the radiofrequency wave along with a moveable plate 13 and a fixed plate 14 which are also electrically conductive. Conductive fingers (preferably metallic) 13*a* and 14*a* engage an inside wall 11*a* of the housing 11. A probe 15 (FIG. 4) is moveable into and out of the cavity 12 and couples the radiofrequency wave to the cavity 12. A conductive grid or screen 16 is mounted on fixed plate 14 and mounts the fingers 14*a*. The plate 14 can mount the fingers 14*a* (not shown). The fixed plate 14 has an opening 14*a* adjacent the cavity 12 and around the axis a—a to allow plasma formed in the cavity 12 to be removed. The cavity 12 could be closed. Preferably a non-conductive cup shaped member 17 (preferably quartz) sealingly covers the opening 14*a* of plate 14. A quartz tube for confining the plasma (not shown) can be inserted through the apparatus along axis a—a in place of cup shaped member 17. The apparatus can also be used for radiofrequency wave processing in chamber 12. The fixed plate 14 is secured to a vacuum source (not shown) by means of bolts 11*f*. The cup shaped member 17 and plate 14 define a plasma chamber 18 which is filled with a gas to create the plasma by a gas supply lines 19 and 19*a*. The basic system is described in U.S. Pat. Nos. 4,507,588; 4,585,668 and 4,630,566.

The improvement in the present invention relates to the mechanisms 20 and 40 for moving the probe 15 and moveable plate 13 in the cavity 12. The mechanism 20 includes three externally threaded posts 21*a*, 21*b* and 21*c* attached to the plate 13 and mounted through a top portion 11*b* of the housing 11. As shown in FIG. 3, planetary gears 22*a*, 22*b* and 22*c* are rotatably mounted on the top portion 11*b* of the housing 11 on internal cover 11*c* by means of support members 23*a*, 23*b* and 23*c* and screws 24. The support member 23*a* includes a bearing 23*d* and spindle 23*d* supporting gear 22*a*. Support members 23*b* and 23*c* are constructed in the same manner. Central gear 25 is rotatably mounted around the axis a—a on bracket 26 on top portion 11*b* by means of screws 27. Bracket 26 includes a bearing 26*a* and spindle 26*b* which mounts central gear 25 so as to engage each of the planetary gears 22*a*, 22*b* and 22*c*. A side gear 28 engages the central gear and is mounted on a shaft 29. The shaft 29 is mounted in a C-shaped member 30. First bevel gear 31 is mounted on shaft 29 and is engaged by second bevel gear 32 mounted on shaft 33 and rotatably supported at right angles to shaft 29 on C-shaped member 30. A rotatable knob 34 is secured to shaft 33 and includes indicia 35 (FIG. 2) for determining increments of position of the knob 34 relative to the C-shaped member 30. Stop 36 is in threaded engagement with shaft 21*a* to prevent movement of the plate 13 beyond a particular point in the cavity 12. As can be seen from FIGS. 1 to 3, the plate 13 is moved along axis a—a by turning knob 34 which rotates shaft 33, first and second bevel gears 31 and 32, shaft 29 side gear 28, central gear 25 and then planetary gears 22*a*, 22*b* and 22*c* which move posts 21*a*, 21*b* and 21*c* vertically and plate 13. The knob 34 can be controlled manually or it can be controlled by a motor (not shown). The central gear 25 spindee 26*b* has an opening 26*c* along the axis a—a which can be used for inserting a quartz tube (not shown) for a confining plasma or an object to be treated with the radiofrequency waves in cavity 12. The top portions 11*b* and internal cover 11*c* have a central opening 11*d* and the plate 13 optionally has an internal opening 13*c* to provide access to cavity 12. A micrometer 37 with a fixed stem 32*a* is secured to top portion 11*b* and a moveable stem 37*b* engages the plate 14. Openings 11*e* are provided for sensors (not shown) to determine the electrical field strength within the cavity 12 at various positions and spacings from the axis a—a. As the plate 13 moves, the micromter 37 measures the change in position.

The mechanism 40 controls the probe 15. The probe 15 is mounted perpendicular to the axis a—a on axis b—b and is moveable into and out of the cavity 10. The probe 15 includes three (3) segments 15*a*, 15*b* and 15*c* which are secured together by threaded extensions 15*d* and 15*e*. Locating members 41 are mounted around the extensions 15*d* and 15*e* and mount the probe 15 inside a tube 42, thereby rigidly mounting the probe 15. The tube 42 has fingers 42*a* for electrical connection to a tubular receiver 43 for the tube 42 mounted on the housing 11 by means of block 44 so that the tube 43 slides into and out of the receiver 43. The tube 42 includes an electrical connector 45 with a projection 46 perpendicular to the axis b—b. Posts 47 and 48 are mounted parallel to the axis b—b. A holder 49 is mounted on the posts 47 and 48 and slideably supports the tube 42. A sleeve 50 mounts a rack 51 on the tube 42. The holder 49 supports a micrometer 52 with a fixed stem 52*a* and a moveable stem 52*b* which engages the projection 46. The position of the moveable stem 52*b* can be adjusted by means of adjuster 52*c* on support 52*d* of the micrometer 52. Gear 53 is mounted on shaft 54 (FIG. 4) to engage the rack 50. The shaft 54 mounts a knob 55 which is used to rotate the gear 53 and thus move the probe 15 into and out of the cavity 12. In operation the knob 55 can be controlled manually or by a motor (not shown). Receiver 60 provides an additional post for another probe (not shown) or for changing the position of the probe 15. The receiver 60 is mounted on block 61.

As can be seen from FIGS. 1 to 4, the control of the probe 15 and plate 13 is by means of knobs 34 and 55. The result is a very simple and precise means for making micrometer adjustments of the probe 15 and plate 13 in the cavity 12. This allows the selection of the mode of the radiofrequency wave as well as adjustments to provide fine tuning within a mode. Micrometers with a digital readout (not shown) can be used. Motors (not shown) can be used to move the plate 13 and probe 15. The result is a very useful and commercially acceptable microwave cavity.

It is intended that the foregoing description be only illustrative of the present invention and that this invention be limited only by the hereinafter appended claims.

I claim:

1. In a radiofrequency wave generating apparatus including a metallic radiofrequency wave cavity which is excited in one or more of its modes of resonance in the cavity around a central axis of the cavity including moveable plate means in the cavity mounted perpendicular to the central axis in the cavity and moveable along the central axis, moveable probe means connected to and extending inside the cavity for coupling the radiofrequency wave to the cavity and control means for moving the probe means and plate means in order to select and control the mode of the radiofrequency wave in the cavity the improvement in the control means for positioning the probe means and the plate means in the cavity which comprises:

(a) support means mounted on the apparatus adjacent an opening in the cavity and extending away from the apparatus so as to define a path into and out of the opening;

(b) sliding means moveably mounting the probe means and mounted on the support means so as to linearly move the probe means along the path into and out of the opening in the cavity along a longitudinal axis of the probe means;

(c) first micrometer means mounted between the support means and the sliding means so as to measure the position of the probe means in the cavity;

(d) guiding means moveably mounting the plate means in the cavity of the apparatus and providing for precise positioning of the plate means along the central axis;

(e) second micrometer means mounted between the apparatus and the plate means so as to measure the position of the plate means in the cavity; and (f) motive means for moving the sliding means and guiding means to control the position of the probe means and plate means in the cavity and providing precise movement of the probe means and plate means in the cavity as determined by the first and second micrometer means.

2. The apparatus of claim 1 wherein the support means is two spaced apart posts mounted on the apparatus with the sliding means mounted between the posts and a holder mounted on the posts with an opening for the sliding means and wherein the first micrometer means is mounted on the holder between the sliding means and the holder.

3. The apparatus of claim 2 wherein the support means and sliding means are provided with gearing means as the motive means for movement of the sliding means and probe means together into and out of the cavity.

4. The apparatus of claim 1 wherein the first micrometer means includes a moveable stem on the micrometer means which engages a portion of the sliding means so that the change of position of the sliding means and probe means in the opening in the support means is measured by a change of position of the stem.

5. The apparatus of claim 1 wherein the second micrometer means is mounted on the apparatus so that a moveable stem of the micrometer means engages the plate means to thereby measure the change of position of the plate means by a change of position of the moveable stem.

6. The apparatus of claim 1 wherein the guiding means comprises multiple threaded rods mounted on the plate means parallel to and equally spaced from the central axis and projecting from the apparatus, outer gears with threaded openings mounted on each of the rods outside of the apparatus and a central gear on the central axis which rotates each of the outer gears to move the plate means along the central axis in the cavity and wherein the motive means engages the central gear to move the plate means.

7. The apparatus of claim 1 wherein the sliding means and guiding means are each controlled by a rotatable knob as part of the motive means so that one knob manually moves the plate means and the other knob manually moves the sliding means and probe means together in the cavity.

8. The apparatus of claim 7 wherein the knobs rotate on a horizontal axis.

9. The apparatus of claim 1 wherein the first and second micrometer means have dial gauges which measure fine increments of change of position.

10. The apparatus of claim 9 wherein in addition the second micrometer menns is provided with a linear scale measuring means for gross measurements of the position of the plate means in the cavity.

11. In a radiofrequency wave generating apparatus including a metallic radiofrequency wave cavity which is excited in one or more of its modes of resonance in the cavity around a central axis of the cavity including moveable plate means in the cavity mounted perpendicular to the central axis in the cavity and moveable along the central axis, moveable probe means connected to and extending inside the cavity for coupling the radiofrequency wave to the cavity and control means for moving the probe means and plate means in order to select and control the mode of the radiofrequency wave in the cavity the improvement in the control means for positioning of the probe means and the plate means in the cavity which comprises:

(a) probe means having a longitudinal axis;

(b) spaced apart locating members mounted along and around the longitudinal axis of the probe means;

(c) a tube mounted on the locating members along the longitudinal axis so that the probe means extends from one end of the tube;

(d) a receiver defining an opening into the cavity wherein the tube is slideably mounted in the opening with probe means extending at the one end of the tube into the cavity;

(e) rack means mounted on the tube parallel to the longitudinal axis of the probe means;

(f) electrical connector means mounted on the tube at an end opposite the one end including a projection away from the longitudinal axis of the probe means;

(g) at least one post mounted on the apparatus so as to support the tube for linear movement of the tube and probe means together into and out of the apparatus;

(h) a holder mounted on the post with an opening slideably supporting the tube between the posts and positioning the tube in the opening in the receiver;

(i) a first dial micrometer mounted on the holder having a moveable stem connected to the dial which engages the projection on the connector means to measure the position of the probe in the cavity as a result of a change of position of the stem;

(j) rotatable first gear means supported on the holder which engages the rack means to move the tube and probe means into and out of the cavity;

(k) a second dial micrometer mounted on the apparatus with a moveable stem connected to the dial engaging the plate means to measure the position of the plate means along the central axis in the cavity as a result of a change of position of the stem;

(l) at least one threaded rod mounted on the plate means parallel to the central axis extending from the cavity of the apparatus;

(m) rotatable second gear means mounted on the threaded rod outside of the cavity for adjusting the position of the plate means in the cavity; and (n) motive means for moving the first and second gear means to provide precise movement of the probe means and plate means in the cavity as determined by the first and second dial micrometers.

12. The apparatus of claim 11 wherein there are at least three rods mounted on the plate means parallel to and spaced from the central axis each with outer gears on each rod rotatable by a central gear around the central axis and wherein the central gear is connected to the motive means.

13. The apparatus of claim 11 wherein the first and second gear means are each manually moveable by rotatable knobs as part of the motive means, wherein a first of the knobs is mounted on the holder and connected to the first gear means and wherein a second of the knobs is mounted on the outside of the apparatus and connected to the second gear means.

14. The apparatus of claim 13 wherein the knob connected to the second gear means rotates on a horizontal axis and is connected by shafts and angle gears to the second gear means.

15. The apparatus of claim 13 wherein the knob for the first gear means rotates on a horizontal axis on a rotatable shaft mounted on the holder which supports the first gear means engaging the rack means.

16. The apparatus of claim 11 wherein there are two spaced apart parallel posts projecting from the apparatus with the tube between the posts and with the holder mounted on the posts.

17. The apparatus of claim 11 wherein the first and second gear means are each manually moveable by rotatable knobs as part of the motive means, wherein the knob for the second gear means rotates on a horizontal axis and is connected by shafts and angle gears to the second gear means, wherein the second gear means includes at least three threaded rods mounted on the plate means spaced from and parallel to the central axis each supporting an outer gear rotatable by a central gear moveable around the central axis and connected to the angle gears and wherein the the knob for the first gear means rotates on a horizontal axis on a shaft mounted on the holder which supports a vertically oriented gear which engages the rack means.

18. The apparatus of claim 17 wherein there are two spaced apart parallel posts projecting from the apparatus with the tube between the posts and with the holder mounted on the posts with the opening in the holder spaced from the opening in the receiver means along the longitudinal axis of the probe.

19. The apparatus of claim 11 wherein the second dial micrometer also includes a linear scale measure for gross measurements of the position of the plate means in the cavity.

* * * * *